United States Patent [19]

Blair

[11] Patent Number: 4,458,658

[45] Date of Patent: Jul. 10, 1984

[54] SLING SHOT

[76] Inventor: Robert N. Blair, 687 Calabasas Rd., Watsonville, Calif. 95076

[21] Appl. No.: 340,077

[22] Filed: Jan. 18, 1982

Related U.S. Application Data

[63] Continuation of Ser. No. 945,249, Sep. 25, 1978, abandoned.

[51] Int. Cl.[3] ..... F41B 7/00

[52] U.S. Cl. ..... 124/20 R; 124/20 B

[58] Field of Search ..... 124/20 R, 20 B, 20 A, 124/41 R

[56] References Cited

U.S. PATENT DOCUMENTS 1,153,415 9/1915 Beaty ..... 124/20 R X 3,494,346 2/1970 Yount et al. ..... 124/20 R

*Primary Examiner*—Richard J. Apley

*Assistant Examiner*—William R. Browne

*Attorney, Agent, or Firm*—Paul B. Fihe

[57] ABSTRACT

A sling shot formed by two laterally-spaced guide members secured on a base member to project generally in the direction of propulsion and encompass a resilient member extending through the guide members and across the forward extremities thereof so as to engage a shot, arrow, or other projectile to enable efficient propulsion thereof.

12 Claims, 3 Drawing Figures

10
12
14
16
18
20
22
24
26
28
30
32
34
36
38
40
42
44
50
52
54
55
56
57
58
60
62
64
A
F
N
2

SLING SHOT

This is a continuation, of application Ser. No. 945,249 filed on Sept. 25, 1978 now abandoned.

FIELD OF THE INVENTION

The present invention relates generally to propelling mechanisms and more particularly to a sling shot wherein a resilient propelling member is utilized to impart propulsion to a projectile such as a shot, arrow or similar objects.

BACKGROUND OF THE INVENTION

A large number of sling shots have been designed for propelling a shot, stone, arrow or other projectile from a portable unit, but because of the limitation in the size and overall dimensions of the sling shot, there have been limitations on the amount of power or force that can be obtained while keeping the size of the unit within reasonable limits so that it can be conveniently carried and stored. More particularly, because the initial velocity that can be imparted to a projectile is dependent upon the kinetic energy imparted thereto and such kinetic energy in turn is dependent upon the work done, which work is determined by the amount of force supplied and the distance over which such force is applied, the noted limitations in the overall size of a portable sling shot have in turn limited the amount of propulsive force that can be obtained.

SUMMARY OF THE PRESENT INVENTION

It is accordingly the general objective of the present invention to provide a sling shot capable of achieving maximal projectile velocity with limited size and resilient strength of the sling shot elements.

By way of introductory information, it is, of course, established that the velocity of a projectile or any other body is related to its kinetic energy by the equation:

$$K=\tfrac{1}{2}mv^2$$

where

K is the kinetic energy of the body, m is the mass of the body, and v is the velocity of the body.

In turn, this kinetic energy is a result of the work done so that if a body is initially at rest, the kinetic energy is equal to the work, W, so that $$W=\tfrac{1}{2}mv^2$$

It is also well known that if a constant force, F, is applied to a body over a certain distance x, then W=Fx, and if the force is variable as in the case of a stretched spring wherein the force F varies in accordance with Hooke's law, $$F=kx$$

where k is the constant of a proportionality of the particular spring or other resilient member, and x is the distance it is stretched;

then the work done, if it is assumed that the force is aligned with the direction of motion, is determined by the integral relation, $$W=\int_{x1}^{x2} F\,dx$$

The mentioned foregoing relations are well established in elementary physics, for example as explained in Chapter 7, page 117 ff. of "University Physics", by Sears and Samansky (second edition).

Given these basic relations and given the fact that practical limitation exists on the size of a sling shot and the strength of the resilient propellant element thereof, the basic principle involved in the present invention provides for the desired amount of work and resultant velocity imparted to a projectile by increasing the distance over which the propelling force effectively operates.

In particular, this increased distance for this application is achieved without necessarily extending the overall dimensions of the unit, so that the same may be conveniently carried and also be of a relatively light weight.

Generally, in accordance with the described principle, a sling shot embodying the present invention includes a pair of laterally spaced guide members for a resilient member in the form of rubber tubing that can be secured to the rear ends of the guide members and extend forwardly therethrough to be connected transversely across the space at the forward extremities of the guide members. The guide members are secured in the desired relationship from a base member which also can extend rearwardly to provide for an arm brace of the sling shot to steady its action during operation, and are preferably mounted on a single bracket joined to the guide members at an intermediate position, thus allowing the forward ends thereof to extend forwardly for a considerable distance beyond the supported position, thus extending the length of the resilient member, and as a consequence the amount of stretch and resultant force and distance that can be applied to a projectile. The resilient member can include a cup-shaped pouch which can engage a shot or other small projectile for propulsion thereof upon appropriate manual actuation.

A handle projects downwardly from the base member and, in accordance with one aspect of the present invention, is releasably secured in an angular position so that by loosening a securing bolt, its precise disposition can be varied to accommodate the particular arm and hand characteristics of a user. For example, an adjustment can be made so that the arm brace can be comfortably accommodated to either a right hand or a left hand user.

The guide members are in the form of tubular elements with an elongated slot to facilitate the insertion of the rubber tubing or other resilient member therein, and can be internally lubricated to reduce the friction. In addition, it is preferred that the guide members mount small pulleys at their forward extremities to reduce the friction of the transversely extending portion of the resilient members, thus to further reduce friction and enable maximal propelling force to be achieved. In one case, these small pulleys are mounted about upright axes whereby the mentioned pouch and shot can be maintained in their forward directions during the propulsion activity, but if the resilient member is integral and is utilized to propel an arrow through connection to a notch in its front hooked end, it is preferred that the pulleys be supported on transverse or substantially horizontal axes during use, to effect downward displacement of the resilient member during the propulsion action so that feathers or other protruding elements on the arrow will not be engaged and the arrow motion consequently impeded.

The structure to be described in detail hereinafter is relatively simple but still achieves the maximal application of force for a given size unit in accordance with the general principles of the present invention.

BRIEF DESCRIPTION OF THE DRAWING

The stated objective of the invention and the manner in which it is achieved, as summarized hereinabove, will be more readily understood by perusal of the following description of two exemplary structures shown in the accompanying drawing wherein:

FIG. 1 is a perspective view of a sling shot embodying the present invention for propelling shot or like objects.

DETAILED DESCRIPTION OF THE EXEMPLARY EMBODIMENTS OF THE INVENTION

Figures 2, 3:
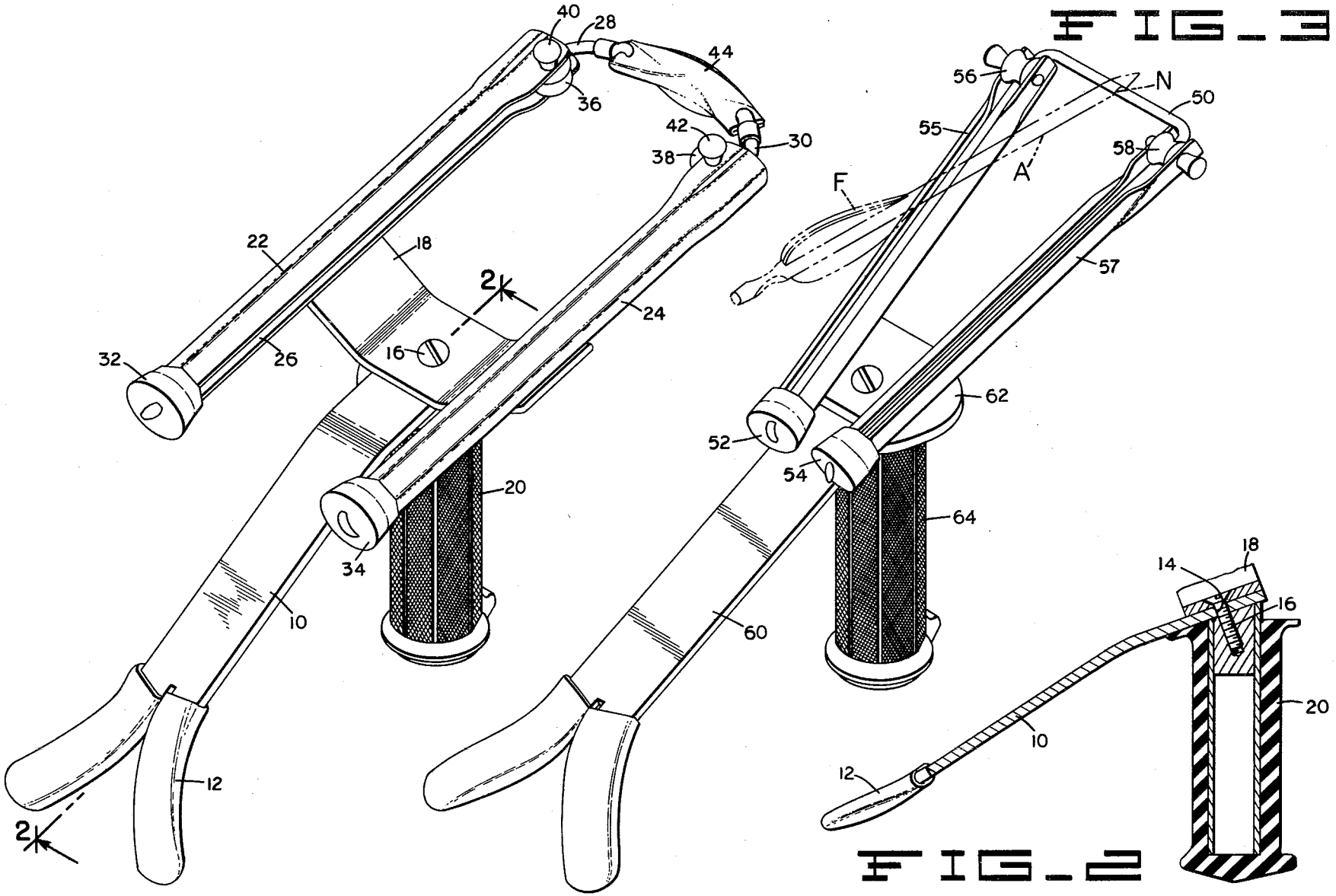
FIG. 2 is a fragmentary longitudinal cross-sectional view taken along line 2 of FIG. 1.
FIG. 3 is a perspective view of a modified embodiment of the invention, for propelling arrows.

With initial reference to FIG. 1, a base member 10 in the form of an elongated rigid strap composed of aluminum or other metal or plastic material extends rearwardly to the lower left, as shown in FIG. 1, to be bifurcated at its rearmost extremity to receive coverings of softer material such as plastic, which can engage the user's arm and ultimately form an arm brace 12 for the unit, to facilitate steadying thereof during operation.

At its forward extremity the rigid strap 10 is provided with an opening 14 through which a single bolt 16 may pass to secure above the rigid strap a bracket 18 and enter at an angular position, as shown in FIG. 2, a plastic-covered handle 20 as will be described in detail hereinafter. More particularly, the bracket 18 extends laterally from the rigid strap and thence upwardly to mount at its opposite extremities by welded or other connections a pair of like tubular guide members 22, 24 having longitudinal slots 26 extending throughout their entire lengths in inwardly facing positions, as illustrated. These tubular guide members 22, 24 are also composed of rigid material and are arranged to accommodate resilient members 28, 30 in the form of rubber tubings or the like. The rubber tubings are secured to and extend from enlarged stops 32, 34, greater in diameter than that of the guide members 22, 24 at both rearward extremities thereof, and then pass around pulleys 36, 38 supported for rotation about upright pins 40, 42 at the forward extremities of the guide members for connection to a pouch 44 at an intermediate position in the transverse space between the forward extremities of the guide members.

Preferably, the pouch 44 is formed by leather or other flexible material folded at its ends for connection to the resilient members to form a cup-shaped receptacle for the shot so as to precisely guide the same during propulsion.

In particular, it is to be noted that the guide members 22, 24 extend substantially forwardly and rearwardly from the supporting bracket, to provide a substantial length of the resilient members in forward and rearward directions from the central supporting bracket 18. The pouch 44, as will be obvious from a viewing of FIG. 1, can be arranged to engage a shot or other projectile and can be withdrawn rearwardly between the two guide members to provide a very substantial length of stretching of the resilient member with a device of relatively small overall dimensions, thus enabling the achievement of maximal accelerating force for the projectile while retaining minimal overall dimensions.

The tubing 28, 30 can be coated with a lubricant to reduce friction and the mentioned pulleys 36, 38 also reduce friction at the point of lateral disposition of the resilient members, thus to minimize frictional resistance to the desired propulsion action.

As mentioned, the securing bolt 16 for the bracket 18 passes through the opening 14 in the base member 10 into the handle 20 at an angle, and when the bolt 16 is loosened, the handle 20, which projects downwardly from the base member, can be adjusted in its angular disposition to accommodate the particular desires of the user. For example, a slight pivoting thereof can accommodate a user who is either right or left-handed, and can also enable the change in the disposition of the guide members 22, 24 to enable sight alignment with the user's normal operational position.

With reference to FIG. 3, a slightly modified embodiment of the invention is illustrated. This embodiment is designed with a single piece of resilient tubing 50 encompassed by guide members 55, 57, secured at its ends by stops 52, 54 and extending around pulleys 56, 58 whose rotative axes are essentially in a plane parallel to that of the supporting rigid strap 60, and thus provide for the displacement of the resilient member at the point of extremity. This particular structure is designed to engage a notch N at the foremost end of an arrow A, as shown in phantom lines in FIG. 3, and allows, because of the disposition of the pulleys, a displacement at and beyond the point of departure of the arrow during propulsion to avoid contact with the feathers F at the rear end thereof. The supporting bracket 62 for the guide members 55, 57 and the handle 64 is substantially the same as that shown in FIGS. 1 and 2, and will not be described in further detail, but the arrow A is angularly held relative to the guide members for propulsion.

Yet further modifications or alterations can be envisioned incorporating the same principle of extending the length of the resilient propelling member without providing a corresponding increase in the overall dimensions of the entire sling shot unit, and as a consequence, the foregoing description of two embodiments is to be considered as purely exemplary and not in a limiting sense, and the actual scope of the present invention is to be indicated only by reference to the appended claims.

What is claimed is:

1. A sling shot which comprises a base member, extending from a position between guide members for steadying the sling shot during operation, a pair of straight elongated laterally-spaced guide members mounted on said base member to extend therefrom both forwardly and rearwardly relative to the direction of propulsion, a resilient member secured to said guide members at their rear extremities and extending through the entire length of said guide members and across the space between the forward extremities of said guide members so that a substantial portion of said resilient member lies within said guide members, and a handle extending downwardly from said base member, at a position intermediate the length of said guide members.

2. A sling shot according to claim 1 wherein said base member includes a rigid strap secured to said guide members and said handle at its forward end.

3. A sling shot according to claim 1 which comprises a single securing member for releasably holding said guide members and said handle to said base member.

4. A sling shot according to claim 3 wherein said securing member is a bolt arranged to enter a threaded opening in said handle at an angle other than a right angle relative to its longitudinal axis.

5. A sling shot according to claim 1 wherein said guide members project forwardly and rearwardly from the point of mounting on said base member.

6. A sling shot according to claim 1 wherein said guide members are tubular and each has a longitudinal slot enabling lateral insertion of said resilient member therein.

7. A sling shot according to claim 1 which comprises a pair of pulleys at the forward ends of said guide members.

8. A sling shot according to claim 7 wherein said pulleys are mounted for rotation on axes substantially perpendicular to the plane defined by said guide members.

9. A sling shot according to claim 7 wherein said pulleys are mounted for rotation on axes substantially parallel to the plane defined by said guide members.

10. A sling shot according to claim 1 which comprises a lubricant on said resilient member.

11. A sling shot according to claim 1 which comprises a cup-shaped pouch secured to said resilient member in the space between said guide members.

12. A sling shot which comprises a base member, extending from a position between laterally-spaced guide members for steadying the sling shot during operation, a pair of elongated guide members secured to said base member with their extremities in laterally-spaced positions, and extending from said base member both forwardly and rearwardly relative to the direction of propulsion, and a resilient member secured to each of said guide members at the rear extremities thereof, each of said guide members being in the form of a long tube and having a longitudinal slot throught the length of wall of each guide member enabling lateral insertion of said resilient member therein.

* * * * *